US005218740A

United States Patent [19]

Snyder et al.

[11] Patent Number: 5,218,740

[45] Date of Patent: Jun. 15, 1993

[54] MAKING ROUNDED CLUSTERS OF FIBERS

[75] Inventors: Adrian C. Snyder, Greenville, N.C.; George L. Vaughn, Taylors, S.C.

[73] Assignee: E. I. Du Pont de Nemours and Company, Wilmington, Del.

[21] Appl. No.: 840,285

[22] Filed: Feb. 24, 1992

Related U.S. Application Data

[63] Continuation-in-part of Ser. No. 508,878, Apr. 12, 1990, abandoned, and a continuation-in-part of Ser. No. 589,960, Sep. 28, 1990, Pat. No. 5,112,684.

[51] Int. Cl.[5] ..... D01G 37/00; D01G 15/00

[52] U.S. Cl. ..... 19/66 R; 19/99

[58] Field of Search ..... 264/15, 40.1, 40.7, 264/517, 114, 117, 115, 121; 19/107, 108, 112, 99, 66 R, 65 R, 66.1

[56] References Cited

U.S. PATENT DOCUMENTS

| | | | |
|---|---|---|---|
| 2,014,673 | 9/1935 | Setzer | 19/99 |
| 2,810,163 | 10/1957 | Kyame et al. | 19/107 |
| 2,923,980 | 2/1960 | Steinruck | 19/112 |
| 3,707,020 | 12/1972 | Stewart | 19/107 |
| 4,135,275 | 1/1979 | Gunter et al. | 19/107 |
| 4,144,294 | 3/1979 | Werthhaiser et al. | 264/15 |
| 4,164,534 | 8/1979 | Ogino | 264/117 |
| 4,241,475 | 12/1980 | Miller | 19/98 |
| 4,355,439 | 10/1982 | Estebanell | 19/105 |
| 4,472,859 | 9/1984 | Elliott et al. | 19/105 |
| 4,524,492 | 6/1985 | Elliott | 19/107 |
| 4,527,307 | 7/1985 | Teichmann | 19/105 |
| 4,618,531 | 10/1986 | Marcus | 428/283 |
| 4,783,364 | 11/1988 | Ilan | 428/288 |
| 4,794,038 | 12/1988 | Marcus | 428/288 |
| 5,033,165 | 7/1991 | Temberg et al. | 19/107 |

*Primary Examiner*—Clifford D. Crowder
*Assistant Examiner*—Larry D. Worrell

[57] ABSTRACT

Ball-shaped and other rounded fiber clusters that have a density that may be controlled, as desired, with good uniformity of size and density, may be obtained from staple fiber that has been crimped mechanically, as well as from spirally crimped polyester staple fiber, by an new process and apparatus at a high throughput. The process including feeding a uniform layer of staple fiber onto a peripheral surface of a rotating main cylinder covered with card clothing and rolling the fiber into rounded clusters.

17 Claims, 4 Drawing Sheets

MAKING ROUNDED CLUSTERS OF FIBERS

CROSS REFERENCE TO RELATED APPLICATIONS

This application is a continuation-in-part of our copending parent application, Ser. No. 07/508,878, filed Apr. 12, 1990, now abandoned and also a continuation-in-part of copending application, filed Sep. 28 1990 by Halm et al, Ser. No. 07/589,960, now U.S. Pat. No. 5,112,684.

FIELD OF INVENTION

This invention relates to improvements in making rounded clusters from staple fiber, and more particularly to a process and apparatus for making such clusters, and the resulting rounded (e.g. ball-like) clusters, especially from resilient crimped fiber of denier 4 to 15 (about 4 to 17 dtex) such as is useful for filling purposes.

BACKGROUND

Staple fiber has long been used as filling material, for support and/or insulating purposes. Polyester fiberfill has been a particularly desirable fiber for such purposes, because of its bulk, resilience, resistance to attack by mildew and other desirable features. Conventionally, fiberfill used to be processed in the form of batts, after the fibers were parallelized on a card (or garnett), because this was an economically attractive and useful way of handling fiberfill.

Recently, however, Marcus has disclosed in U.S. Pat. Nos. 4,618,531 and 4,783,364 how spirally crimped fiberfill can be formed into fiberballs that make a particularly desirable filling material, being lofty, soft and refluffable in a way that is similar to down filling. Marcus has also disclosed in U.S. Pat. No. 4,794,038 how fiberballs can be made similarly from blends of fiberfill with binder fiber, which can then be activated to make useful bonded support structures, e.g. for cushioning and mattresses. Marcus has disclosed a useful batch process and apparatus that takes advantage of the spirally crimped nature of his feed material for making such fiberballs, which are being produced commercially and have proved useful and interesting ball like fiber structures, because of their lofty nature, because they are easily transported by air conveying during processing, and because of the interesting and advantageous properties of the products, which may be processed into several interesting variants. We generally refer to these structures herein as fiber clusters.

An object of the present invention is to provide a process and apparatus that can be operated to provide such ball like clusters of fibers continuously at high throughputs. Another object is to provide a process and apparatus that does not necessarily require a special feed fiber, but can be operated satisfactorily also with regular polyester staple fiber, or indeed other fibrous materials, to form fiber clusters of such densities and uniformity as may be required. A further object is to provide a process and apparatus that may be used to form clusters from fibers of coarser denier, even above 10.

As will be noted hereinafter, we have made several modifications to a type of carding machine in order to achieve our results.

SUMMARY OF THE INVENTION

According to one aspect of the present invention, there is provided a process for preparing rounded clusters of fibers, comprising feeding a uniform layer of staple fiber onto the peripheral surface of a rotating main cylinder covered with card clothing, whereby the fiber is advanced around the peripheral surface by said clothing and is brought into contact with a plurality of frictional surfaces, whereby said fiber is formed into clusters that are rolled into rounded configurations on the peripheral surface, characterized in that there is provided at least one arcuate doffing screen, radially spaced from said clothing, said doffing screen being provided with openings of sufficient size for the clusters to pass through said openings, and to be doffed by emerging through said openings.

Use of a screen to doff clusters is a significant difference from existing carding machines, which have generally used a roll to doff carded fiber.

We have doffed clusters very effectively using an arcuate ribbed screen that is provided with transverse ribs with bases that are spaced radially from the clothing on the main cylinder, and with openings that are the transverse spaces between these ribs. It will be understood herein that "transverse" means transverse to the machine direction, i.e., the direction of rotation of the main cylinder, so the "transverse" ribs of such doffing screen are parallel to the axis of the main cylinder.

According to another aspect of our invention, therefore, there is provided a cluster forming machine that is an improvement in a staple fiber carding machine comprising a rotatable main cylinder having its peripheral surface covered with card clothing and adapted to rotate in close proximity with a plurality of cooperating frictional surfaces, means to feed staple fiber in a uniform layer onto said main cylinder, and doffing means, the improvement characterized in that said frictional surfaces cooperate with the card clothing on the peripheral surface of the main cylinder in such a way that fiber clusters are formed by the cooperation between the card clothing and said frictional surfaces, and the doffing means comprises a doffing screen provided with openings of sufficient size for the fiber clusters to emerge. Examples of "cooperating frictional surfaces" are described herein, and include stationary elements with frictional surfaces, such as plates and segments that may be smooth or covered with card clothing, and screens, and also movable elements, including worker and stripper rolls, such as are used on roller top cards, and belt driven flat elements, such as are used on revolving flat cards.

An important advantage according to the invention is that doffing and transportation of the emerging clusters may be assisted by suction and/or blowing. For instance, the rounded clusters may be blown directly into tickings and formed into pillows or other filled articles. Alternatively, the clusters may be packed and later processed as desired.

According to another aspect of our invention, there is provided an improved process for preparing rounded clusters of fibers, comprising feeding a uniform layer of staple fiber onto the peripheral surface of a rotating main cylinder covered with card clothing, providing a plurality of essentially arcuate frictional surfaces that are spaced radially from said clothing, wherein the radial spacing and frictional characteristics of said frictional surfaces and of said clothing and the rate of feed of said staple fiber are controlled so that said clothing becomes loaded with a compressible layer of fibers, whereby lofty rounded clusters of fibers are formed in the peripheral space between said clothing and said frictional surfaces, and doffing said clusters. As will be described herein, the fact that the card clothing is loaded with fiber is another significant difference from operating a conventional carding machine of this type. It is very surprising that rounded clusters are formed in the peripheral space when these (arcuate) frictional surfaces are so spaced and the process is so operated, as described herein.

The staple fiber that is fed to the main cylinder may be in various forms, e.g. a cross-lapped batt, or may be bale stock that has previously been baled, but is fed to the main cylinder after having been opened.

Preferably, especially for making pillows, filled articles of apparel, or like articles where such aesthetics are important, the staple fiber fed to the main cylinder may have been slickened.

For lower density and better insulation, staple fiber of hollow cross section is preferred.

If desired, for making bonded support articles, the staple fiber fed to the main cylinder may be a blend of polyester fiberfill or other high melting fiber blended with lower melting binder fiber.

The denier of the feed fiber will generally be at least 4 dpf (about 4 dtex) for use as filling material, and may be significantly higher, especially for support purposes, but will be selected according to the desired end use. For instance, useful blends for apparel insulation have been made from fiber of denier as low as 1–2 dpf (about 1–2 dtex), and even lower denier fibers are now available. The higher deniers may be as high as 15 dpf (about 17 dtex), or more.

By use of our invention, as described hereinafter, we have found it possible to process staple fiber that has been mechanically crimped, and to produce desirable lofty fiberballs of uniform average density. In this regard, reference is made to copending allowed application, Ser. No. 07/589,960, referred to above, and which is incorporated herein by reference, as a disclosure of mechanically crimped fiber that is particularly useful as feed fiber according to the parent application.

According to another aspect of our invention, therefore, there is provided a mass of lofty rounded staple fiber clusters of average dimension about 1 to about 15 mm, and of average density less than about 1 pound per cubic foot (about 16 Kg/cu m), consisting essentially of randomly entwined, mechanically crimped synthetic staple fiber of cut length about 10 to about 60 mm. These lofty clusters are randomly arranged and entwined as in Marcus' fiber clusters prepared from spirally crimped feed fiber; they are quite distinct from the hard neps or nubs that have been used in novelty yarns, and that are small knotted or tangled clumps of synthetic fibers or indeed of natural fibers, such as cotton. As indicated, preferred forms of our mechanically crimped synthetic fiber may be slickened polyester staple fiber, and/or a blend with a lower melting binder fiber, that may, if desired, be a sheath/core bicomponent with a sheath of lower melting binder material, and a core of polyester or like high melting fiber forming material.

DETAILED DESCRIPTION OF THE INVENTION

Figure 1:
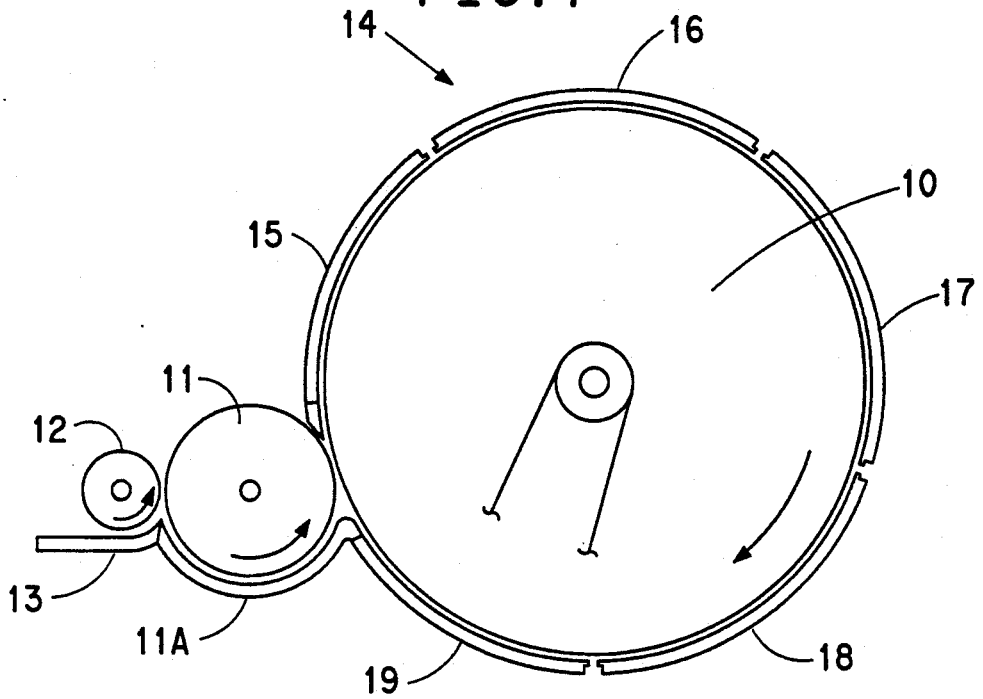
FIG. 1 is a schematic side view in elevation of a preferred apparatus according to the present invention.

A preferred apparatus according to the invention will be described with reference to FIGS. 1–5 of the accompanying drawings. As indicated, in some respects, some of the features of this apparatus resemble a card (or carding machine) from which, for convenience, such elements and features have been adapted.

So, reference is made to the art on carding, including a Manual of Textile Technology, in the Short Staple Spinning Series, Volume 2, entitled "A Practical Guide to Opening and Carding", by W. Klein, The Textile Institute, 1987, and to a summary of available types, in an article by B. Wolf, in International Textile bulletin 2/85, pages 9, 12, 16, 19 and 20, referred to on page 35 of Klein's Manual, both the Manual and the article being hereby incorporated herein, by reference.

The tasks of a card are listed in the former as:

Opening to individual fibers
Elimination of impurities
Elimination of dust
Disentangling of neps
Elimination of short fibers
Fiber blending
Fiber orientation and
Sliver formation.

Such are indeed the tasks of most cards. In other words, such tasks (of most cards) do not include forming ball like fiber clusters. However, cards have been used by some to entangle fibers into bodies variously referred to by terms such as neps, nubs, and other terminology. This technology has been regarded as proprietary, so the literature on processes that may have been used for this purpose is sparse. Steinruck, however, disclosed an apparatus for making nubs in U.S. Pat. No. 2,923,980. Steinruck indicated that, previously, as many as 10 machines in a row had been used to reduce the fiber stock to the desired small hard nubs. Steinruck said his machine could be operated to form nubs of the size and hardness desired by perhaps as few as 2 machines in sequence. Even this need for a sequence of 2 machines is, however undesirable, and so we have provided a machine that can make our desired clusters on a single machine. Steinruck wanted hard neps or nubs. In contrast, we want to make resilient lofty ball-like structures of controlled and uniform density. Another difference from prior art nep (or nub) formation is that these have generally been made from fibers of low dpf (denier or dtex per filament of less than 3) such as cotton and other low denier fibers that knot easily and can form hard neps that are useful in novelty yarns. When a filling is used for support purposes, such low dpf fiber is generally not as desirable as higher deniers of 4 (about 4 dtex) and above (even up to 15 denier, about 17 dtex) that are generally preferred, because of their resilience. This property, however, increases the difficulty of making clusters that will not later unravel. It should be understood that our process and machine may also be operated with low denier feed fiber that is easier to form into clusters. In other words, although higher denier synthetic fibers are generally preferred as filling material, lower denier synthetic and natural fibers may also be formed into fiber clusters by our process and machine.

As emphasized by Steinruck, his objective of forming nubs is almost the reverse of the primary function of operating an ordinary card (to lay individual fibers as much as possible in parallel lines and to remove any neps or nubs). Indeed, a book was published by Wira, entitled "Nep Formation in Carding", by P.P. Townend, to advise how to avoid the major problem of nep formation in the carding of staple fibers. Steinruck wanted to convert his fibrous mass into nubs which Steinruck would later incorporate into webs or slivers on a card in a subsequent operation. Steinruck used a (modified) roller top card, and it is believed that other existing processes for making neps, nubs, etc., have generally used roller top cards. In contrast, for a preferred machine according to the present invention, we have modified a card with carding plates (somewhat as shown in FIG. 101 on page 45 of the Manual by Klein, or in FIG. 22 on page 20 of the article by Wolf, both referred to hereinabove). Our objective is also the reverse of the primary function of operating an ordinary card.

Our preferred machine is illustrated in FIG. 1 (which does not show the card clothing) and consists essentially of a main cylinder 10, of diameter 50 inches (about 1.3 m), that is covered with card clothing, and that is shown driven in a clockwise direction at a rate that largely determines throughput, being generally some hundreds of revolutions per minute (rpm), preceded by a roll 11 that is referred to as a lickerin (Klein refers to this as a "taker-in"), of diameter 9 inches (about 23 cm), that is also covered with clothing (but of much lower point density), and that is shown driven in a counter clockwise direction, i.e., opposite to that of main cylinder 10, with an underlying basket 11A, and itself preceded by a feed roll 12, that is shown driven also in a counter clockwise direction (like lickerin 11), and that cooperates with a feed plate 13 in feeding opened fiber from a source of supply (not shown) at a uniform rate evenly across the width of lickerin 11. The periphery of main cylinder 10 is surrounded by a series of stationary cooperating frictional surface elements, indicated generally by 14, and more specifically (serially from lickerin 11) as 15, 16, 17, 18 and 19, all of which have arcuate frictional surfaces that are spaced-radially from the (teeth of the card clothing on) main cylinder 10 to allow processing (into clusters) fiber fed from lickerin 11 within the peripheral space around main cylinder 10, and defined on the outside periphery of such space by the arcuate frictional surfaces of these stationary elements 14. The radial spacing may be adjusted, and this can be an important means for controlling the process and the products produced.

As indicated, opened fiber is uniformly fed between feed plate 13 and feed roll 12, which latter is provided with teeth (or other means) to advance the fiber towards lickerin 11, more or less as shown in FIG. 84, on page 39 of Klein's Manual. The clothing on lickerin 11 forwards the new fiber (fed from feed roll 12 and feed plate 13) past underlying basket 11A to the clothing on main cylinder 10. Both sets of clothing are travelling in the same direction, but that on main cylinder 10 is moving at a much higher speed. Thus, the new fiber is picked up by the teeth on main cylinder 10 and enters the space between the arcuate frictional surfaces of stationary elements 14 and main cylinder 10 (covered with card clothing). During start-up, new fiber (fed from lickerin 11) will load onto the card clothing on main cylinder 10, and so some minutes are likely to pass before any product is delivered in the form of ball-like clusters. Also, as will be evident, a certain amount of empiricism may be needed to adjust the feed rate of any particular feed fiber to the surface speed of the main cylinder, clothed with appropriate card clothing, and surrounded by appropriately spaced stationary elements 14, in order to obtain a satisfactory delivery of the desired clusters, and steady state operation. Once the processor reaches steady state operation, i.e. once the amount of fiber (in the form of rounded ball like clusters) delivered by main cylinder 10 is the same as the amount fed to the processor, the card clothing on the main cylinder will have become loaded with fiber that has worked its way down the teeth, so the new fiber can only be collected at (or near) the outer extremities of the teeth of the card clothing. However, surprisingly, this fiber is not loaded uniformly in density or spatially (when the processor is run with a correct feed rate of fiber and main cylinder speed); in other words, there are relatively high locations loaded with more fiber and contrastingly lower locations loaded with less fiber across the width of the main cylinder and in the direction of rotation.

This loading of fiber on the main cylinder, according to this preferred aspect of our invention, is an important difference from a carding operation (using this type of machine, before modification). During such carding, it is desirable to doff all the fiber so that only a very thin layer of fiber is fed and so that all is doffed. In other words, during such carding, it is important to avoid loading the cylinder.

Figure 2:
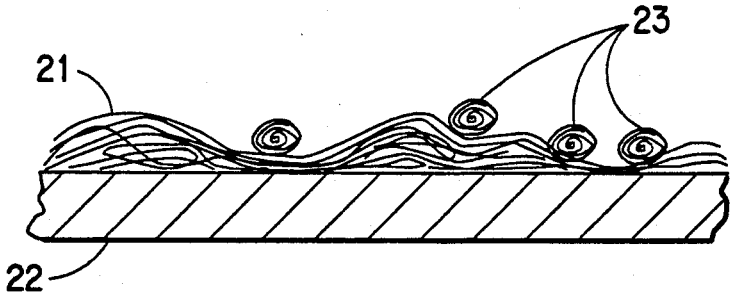
FIG. 2 is a sketched representation of how a section cut through card clothing loaded with fiber that has been removed from a main cylinder, might show the topography of the surface, as will be described hereafter.
Figure 3:
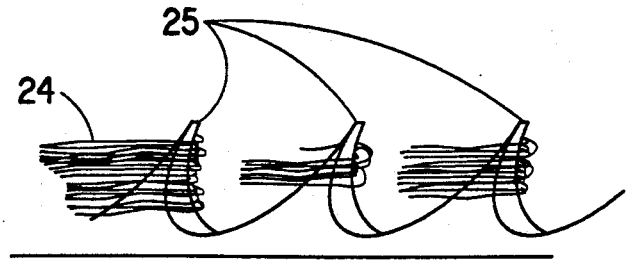
FIG. 3 is a sketched representation of how carding teeth grip the fibers.

Such loading according to our invention is represented in a sketch in FIG. 2, showing how a typical section might look if cut through the card clothing and fiber on a loaded main cylinder (not shown in FIG. 2) in a simplified and idealized view. The upper portion 21 shows fiber while the lower portion 22 indicates the location of the card clothing (some of which would be gripping fiber). FIG. 3 is a sketched representation of how fibers 24 are gripped by carding teeth 25 of a type that we have used. As some of the fiber shown in the upper portion 21 of FIG. 2 is released in clusters 23, and is no longer gripped by the card clothing, such clusters pass through the space between the card clothing (loaded with fiber) and stationary frictional surface elements 14, and are believed to follow tortuous paths, and so to be rolled and become rounded clusters. As the clusters progress around main cylinder 10, they reach the space between the surface of main cylinder 10 and a doffing screen, which is one of the stationary elements 14, specifically element 17, which is a ribbed screen.

Figure 4:
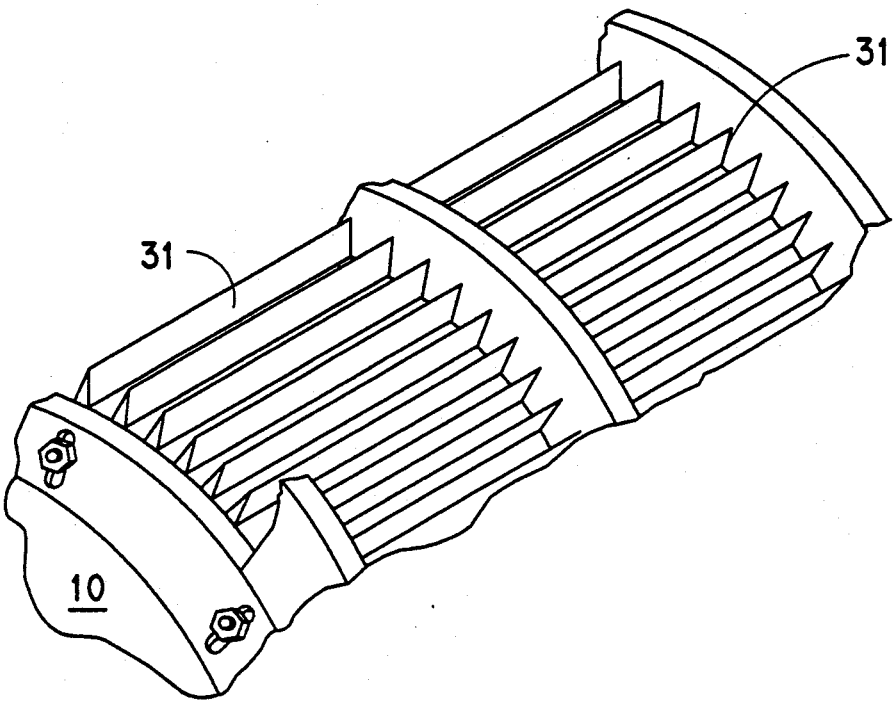
FIG. 4 is a schematic view in perspective of a portion of a preferred ribbed screen according to the present invention.
Figure 5:
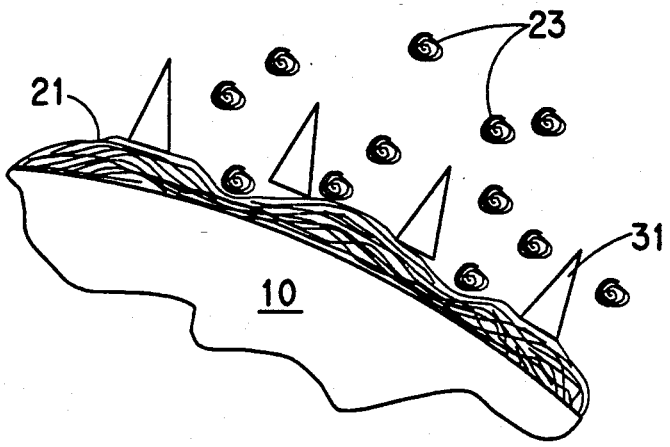
FIG. 5 is a sketched representation of an end view of a portion of the main cylinder and doffing screen with the clusters emerging.

We have used as such a ribbed doffing screen 17, a screen such as has previously been used underneath commercial cards (probably shown under the main cylinder in FIG. 101 on page 45 of Klein's Manual) for the different purpose of removing waste. We prefer, however, to doff our fiber clusters through screens with larger spacings between the ribs. One type of preferred screen is described now with reference to FIG. 4. The ribs 31 of such screen run transversely (i.e. parallel to the axis of main cylinder 10) and are shaped conveniently with triangular cross sections, with smooth bases that are spaced radially from the surface of main cylinder 10, and are separated also transversely along their lengths from each neighboring rib, so the rounded fiber clusters may continue to roll in the arcuate space between main cylinder 10 and the frictional surfaces that are the bases of the ribs of the screen, but may; also emerge between the ribs, because of centrifugal force. This is represented in FIG. 5, which shows clusters 23 emerging between ribs 31, after being released from the loaded fiber 21 in the peripheral space between the ribs 31 and main cylinder 10. Any loose fiber or incompletely-formed cluster is less likely to emerge from the process or through the transverse spaces, and such fiber masses as do not emerge may roll back down the sides of the ribs to reenter the arcuate space around main cylinder 10. As the fiber clusters emerge, they may be collected, e.g. under low suction, and delivered, e.g. for packing and shipping, or for further processing, by an air conveying system. An important advantage of fiber-fill in the form of round clusters which do not readily entangle, is the ability to transport them easily by blowing.

As will readily be understood, a doffing screen may advantageously be used to doff clusters made on other types of machines, different from the preferred type according to our invention.

Figure 6:
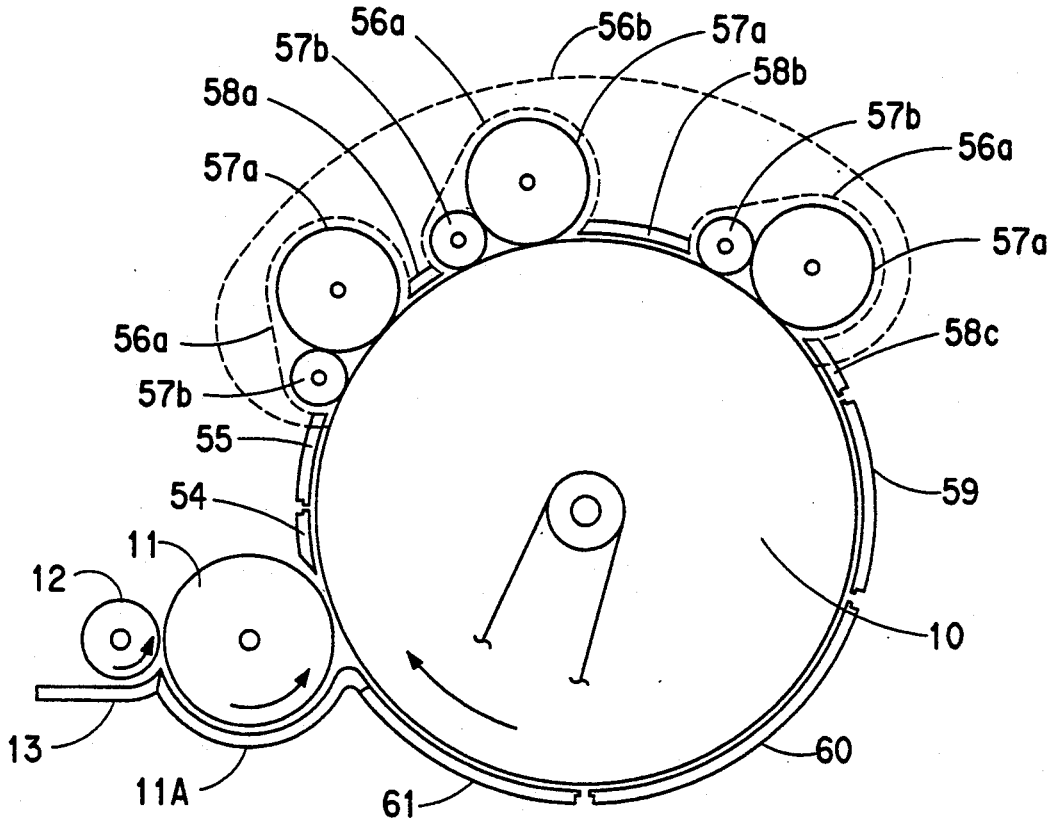
FIGS. 6–9 are schematic side-views in elevation of alternative embodiments according to the invention.

Referring to FIG. 6, a typical modern single cylinder roller-top card has a feed roll 12 and feed plate 13 which bring feed fibers to the lickerin 11. The feed roll can be fluted, knurled or have card clothing The fibers are transferred from the lickerin to main cylinder 10, which is usually clothed with metallic wire. Once the fibers are on the main cylinder, they pass under a first stationary element called the bottom back plate 54, then on under a second element, top back plate 55; both plates can be smooth or have clothing; then on (under optional cover 56A) to contact a first set of worker rolls 57A and stripper rolls 57B. These rolls have metallic clothing and rotate at a much slower surface speed than the main cylinder 10. There can be as few as one (1) set of worker-stripper rolls or more, as many as 6 sets located peripherally around main cylinder 10. Optionally, a cover can cover an individual set of worker-stripper rolls, as shown by 56*a*, or can cover all sets, as shown by 56*b*.

For carding, the worker-stripper set direction of rotation is normally opposite to that of the main cylinder. The clothing orientation of worker roll 57*a* is normally such that, at the point of tangency between the worker and main, the tips of the metallic wire on the worker point toward the feed end of the card, while the tips of metallic wire on the main point toward the doffing end of the card; thus a carding effect occurs at the nip or bight between the worker 57*a* and main 10. The normal clothing orientation of the stripper roll 57*b*, on the other hand, is in the same direction as the worker, if viewed at the point of tangency of the worker and stripper. This allows the clothing of the stripper to 'strip' the fibers from the worker and carry them around to be removed or 'stripped' from the stripper by the to be removed or 'stripped' from the stripper by the clothing on the main cylinder.

Also, for carding, it is highly desirable to avoid loading the main cylinder with fiber, since loading can lead to unsatisfactory carding performance and eventually to equipment damage.

In contrast, in order to make clusters on the roller-top card, clothing orientation and direction of rotation of both worker and stripper rolls should be adapted to achieve a fiber rolling action, instead of carding and stripping, at the bights or points of tangency. These rolls can have variable types of clothing and be separated one from the other by varying distances, depending on how much work one desires or requires to form the cluster and, they can rotate at various ranges of speed or be stationary for the same reason. On cards less than 60 inches (about 1.5 m) wide, there are usually plates 58*a* and 58*b* to contain fiber fly and waste. Cover 56*b* allows clusters to escape the cylinder, without escaping the process, and to reorient or reposition, sometimes upstream—sometimes downstream, when next contacting the main cylinder 10. It is desirable for main cylinder 10, as well as the workers 57*a* and strippers 57*b*, to become loaded with fiber to a low but sustainable level since this loading facilitates rolling low density clusters.

Continuing on around the periphery of the main cylinder, element 58*c* is a top front metal plate and is usually smooth but can be clothed with metallic wire. Element 59 can be a top front doffing screen, having ribs and open slots of the proper width between ribs for cluster removal, or an appropriately-clothed doffing or brush roll covered by a contoured shroud to direct and remove clusters from the main cylinder and assist in transferring them to the next process stage. Element 60 is the bottom front screen which can be used as a supplemental doffing screen of similar design as element 59 above or can be solid, without openings. Elements 59 or 60 can be replaced by a covered (shrouded) doffing roll to enhance product removal, as described herein-after.

Element 61 is the bottom back screen and can be used as a supplemental doffing screen of similar design as element 59 or can be solid, i.e., without openings. Element 11*a* is the lickerin basket, whose function is to make sure fiber does get transferred from the lickerin 11 to the main 10 instead of falling off or being blown off by air currents in the vicinity.

Figure 7:
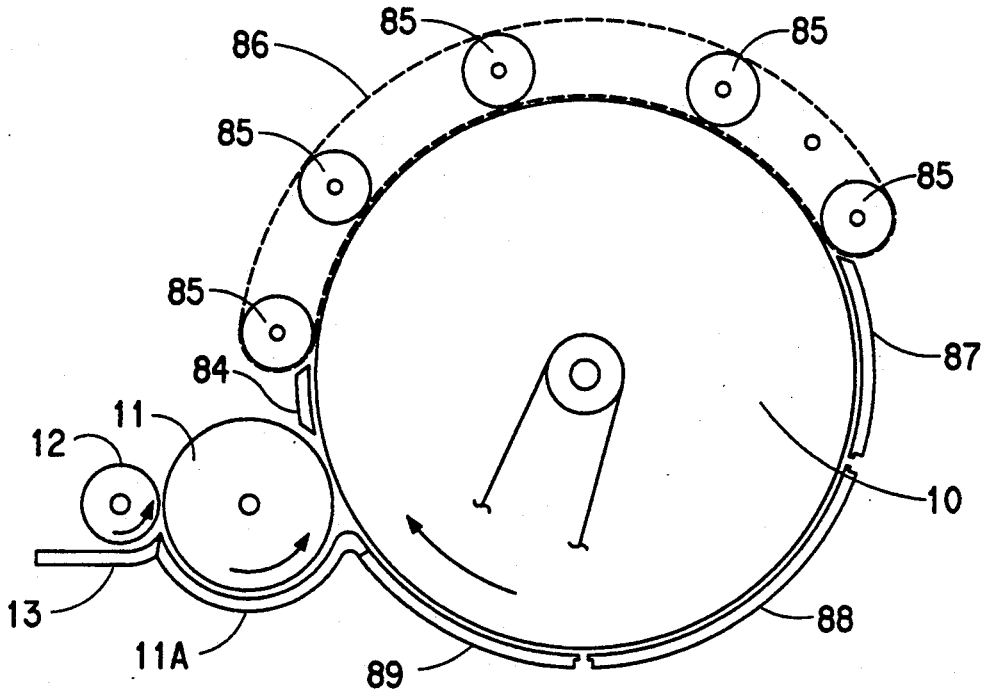

Referring to FIG. 7, a typical modern single cylinder revolving flat top card has a feed roll 12 and feed plate 13 which bring the fibers to lickerin 11. The feed roll can be fluted, knurled or have card clothing.

The fibers are transferred from the lickerin to main cylinder 10 which is usually clothed with metallic wire. Once the fibers are on the main cylinder, they pass under a first stationary element, called the bottom back plate 84, which can be smooth or clothed, then on under flats 86 which are supported on several carrier wheels 85. These flats are narrow strips (usually more than 1 inch (2.5 cm) wide, and less than 3 inches (7.5 cm) wide), which can have wires or metallic clothing, at various point densities (points/square inch), or they can be smooth. Direction of rotation of the flats on the carrier wheel loop is normally in the direction opposite from that of the main; but these flats can also be run in the same direction as main cylinder or they can be stationary. Typically a flat top card contains a "flat grinder stand" that serves no purpose in the carding or cluster making process, so is not shown in FIG. 7.

For carding, at the point of tangency of the flat and main cylinder 10, the points on the wires or metallic clothing of the flat usually point toward the feed end of the card while the points on the main clothing point toward the doffing end of the card. It is highly desirable to avoid loading the main cylinder 10 with fiber, since loading can lead to unsatisfactory carding performance and eventually machine damage.

In contrast, for cluster making, the following should be observed. When the direction of rotation of the flats on the carrier wheel loop is opposite to the main, then the points on the flats, if the flats have clothing, should point (as do the points on the main) toward the doffing end of the cylinder. Given appropriate main 10 and carrier wheel 85 (flat) speeds, this provides an environment suitable for rolling fibers. This same type of rolling action can be obtained if the direction of rotation of the flats is the same as the main, by making sure of the points of the clothing on the flat are pointing in the same direction as the main, and the flats should move at a slower surface speed than the main cylinder.

Loading the main cylinder with fiber to a low and sustainable level is desirable for cluster making, since it facilitates the formation of low density clusters.

Elements 87, 88, and 89 and their functions correspond to elements 59, 60, and 61, respectively, of FIG. 6.

Although a doffing screen is preferred, according to the invention, other methods of doffing may be used, as described more particularly hereinafter, with regard, particularly, to FIGS. 8 and 9.

Figure 8:
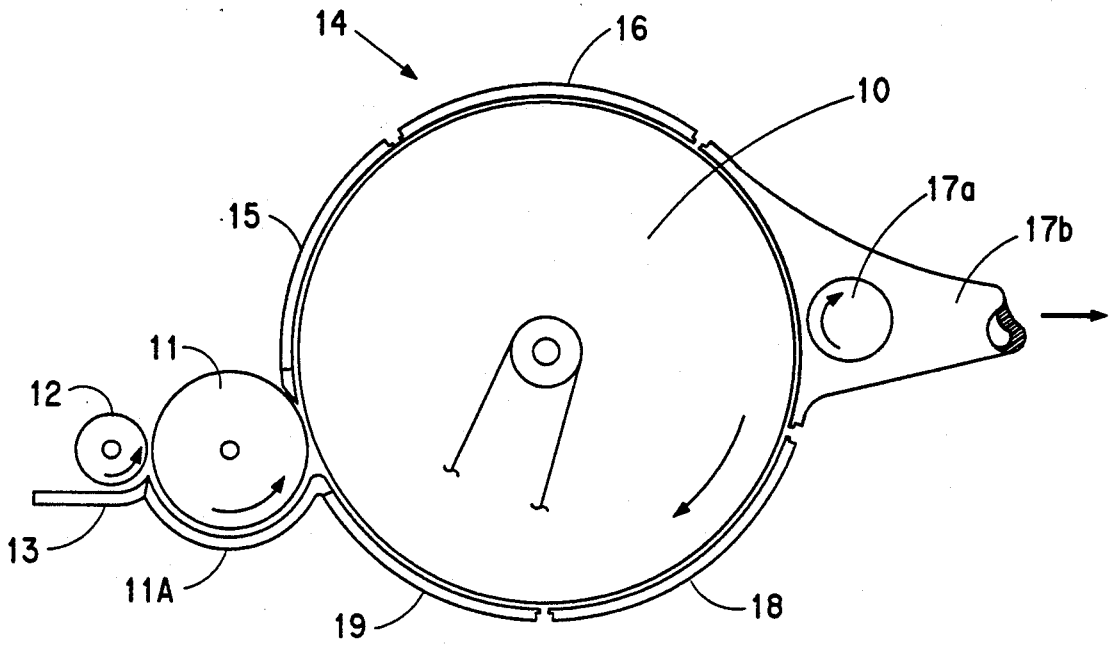
Figure 9:
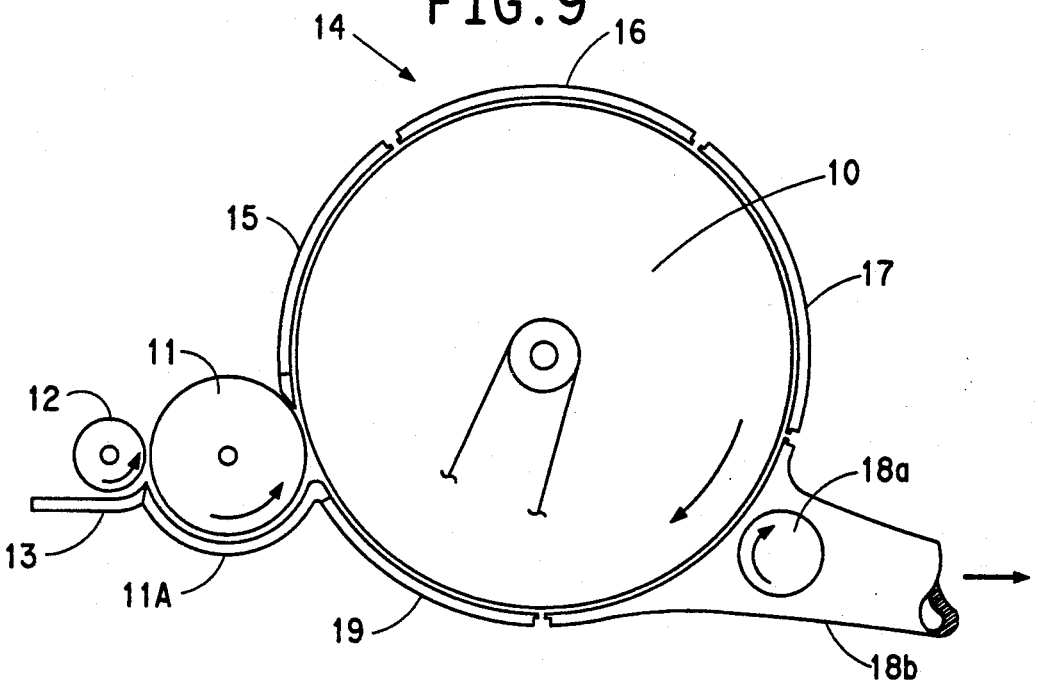

FIGS. 8 and 9 show alternate positions for a shrouded doffing roll 17*a* to replace screens 17 and/or 18 in the embodiment shown in FIG. 1. Such a doffing roll 17*a* may be used as an assist to remove clusters from the main cylinder 10 and direct them to an air conveying system, not shown, but to the right of FIGS. 8 and 9. The doffing roll clearance from the main cylinder for this application is significantly larger than for a standard doffer roll. Clearances of more than 0.25 inches (6 mm) would not be uncommon according to the invention, whereas standard doffer clearances are about 0.007 inches (0.175 mm). A doffer roll according to our invention can rotate in either clockwise or counterclockwise directions in reference to the main cylinder (which is shown to rotate clockwise), whereas, on a standard card or garnett, the doffer rotates in a direction opposite to the main cylinder. The surface speed of the doffer roll, regardless of direction of rotation, is preferably more than that of the main cylinder, and should not be less, to avoid fiber buildup and carding action at the bight, or point of tangency between the doffer and the main. The doffer roll clothing can be any of several types, e.g., continuous wire, conventional or fillet type wire, but the preferred point orientation is in the direction of rotation, whereas, on a regular doffer roll, the point orientation is opposite the direction of rotation. Preferred clothing on the doffer roll is a wire with a low rake angle, to prevent clusters from hanging up on the points and causing an overload situation. Another difference between our doffing concept and a standard doffer is that we do not need a vibrating comb to remove the fibers from the doffer, whereas a standard doffer uses a vibrating comb.

The next element 18 may also be a screen that acts as a further doffing screen, and performs a similar function. The last element 19 may also be a screen, referred to as a bottom back screen; this element is preferably, however, a plate to provide a frictional surface without doffing. Element 19 may be connected to lickerin basket 11A, as shown in FIG. 1, to avoid loss of fiber from the machine at this point.

Although five frictional surface elements 14 are shown in FIG. 1, it will be understood that the invention is not limited to only five such elements, and more or less may be used, if desired. Indeed a larger number have been used, as disclosed in the Examples herein.

We have found the following aspects affect the process of our invention and the resulting products. With regard to the card clothing on the main cylinder, increasing point density generally reduces the potential to form a compressible fiber loading on the main cylinder, which leads to making clusters that are more dense, less rounded and less acceptable for end uses like pillows and bedding. Conversely, a lower point density generally allows for more fiber loading of the main cylinder, and generates a topography that is more conducive to fiber cluster making. A more aggressive tooth angle is preferred with fibers having higher degrees of slickness. Even a very aggressive tooth angle may not be sufficient when the point density gets extreme, e.g. more than 800 ppsi (points per sq in, and equivalent to about 124 points per sq cm), as this will eventually make loading practically impossible and so desirable low density cluster formation will also not be possible. Less aggressive teeth will not hold highly slickened fibers, and this will reduce the potential to form an acceptable cluster. With semi-slick and dry fibers, a less aggressive tooth is required to (1) prevent overloading the main cylinder and (2) allow a stable load and topography due to higher fiber-fiber & fiber-metal friction to achieve well-rounded cluster formation. The speed of the main cylinder should be matched to the fiber feed rate. If the speed is not high enough, then the main cylinder, as well as the lickerin, can overload, and overloading leads to unacceptable cluster formation, and may even damage the machine. Once the main cylinder has reached a sufficient speed to satisfy the fiber feed rate, stable loading and good cluster formation will occur. Increasing the speed without increasing fiber feed will usually result in smaller, denser clusters. The fiber feed rate should be tuned to the spacings between the frictional surfaces and the main cylinder, and to the speed of the main cylinder. If the clearances are too tight, then this can overload the main cylinder, or make very tight, dense non-round clusters. As the clearance is increased, then the balls may become more hairy, i.e. have more free ends. Higher feed rates can be accommodated with appropriate clearances and speed to give good clusters. The clearances (spacings) between the main cylinder and the frictional surface elements should not be too tight, or this will cause very dense loading of clothing and lead to cluster forms that may be unacceptable. The spacings need to be adjusted to achieve a stable loading (topography) and can be used to help change the average ball diameter. These spacings may be adjusted by conventional means, such as slots in the rims of the elements 14, with bolts on the main cylinder and nuts to tighten and fix the elements at the desired spacing, as shown in FIG. 4.

As with conventional cards, the various elements 14 surrounding the circumference of the main cylinder may themselves be surrounded by removable sections of covering plates to retain any loose fiber that would otherwise escape, but these are not shown in the interests of clarity and simplicity.

The invention is further described with reference to the following Examples, in which all parts and percentages are by weight, unless otherwise indicated. For test procedures and in other respects, reference may be made to the Marcus U.S. Pat. Nos. 4,618,531, 4,783,364 and 4,794,038, and 4,818,599, which are all hereby specifically incorporated herein, by reference. Different feed fibers may require different process and/or machine features for appropriate cluster-formation to be performed, so different feed fibers have been processed. Some of the different feed fibers are exemplified below, and others may be processed, by suitable adjustment of the various process and apparatus features mentioned. In the first Example, we processed slickened spirally-crimped fiber, because the 3-dimensional crimp of such fibers is preferred for ease of ball formation, and slickened fiberfill is also generally preferred for aesthetics.

EXAMPLE 1

A tow of asymmetrically jet-quenched, drawn, slickened, poly(ethylene terephthalate) filaments of 4.5 den (5 dtex) was prepared conventionally, without mechanically crimping, using a draw ratio of about 2.8X, applying a polysiloxane slickener in amount about 0.3% Si OWF, and relaxing at a temperature of about 175° C. in rope form. The rope was then cut into 32 mm (about 1.25 inches) staple, and relaxed again at about 175° C. The crimp developed by this process is 3-dimensional in nature and is a non-chemical approach to achieving a spiral-type of crimp. The staple was formed into a bale, compressed to a density of approximately 12 lb/cu. ft (about 192 Kg/cu m).

The stable was opened using a "Masterclean" opener (available from John D. Hollingsworth-On-Wheels, Greenville, S.C.) and then manually charged to the hopper section of a CMC Evenfeed (available from Rando Machine Company, Macedon, N.Y.), which presented a uniform amount of opened feed fiber across the width of the processor.

The processor was as shown in FIG. 1, being a 40 inch (1 meter) wide card (available from John D. Hollingworth on Wheels, Greenville, S.C.) modified so as to have the following essential elements:

(1) Feed roll 12 (2.25 inch diameter, i.e. almost 6 cm) with feed plate 13 whose function is to meterfiber to lickerin 11. Feed roll speed was controlled independently with a separate DC motor and drive. Fiber throughputs were determined by weighing product delivered by the processor over a prescribed time period. Feed roll 12 rotates in a counterclockwise; direction as shown.

(2) Lickerin roll 11 (9 inch diameter, about 23 cm) whose function is to remove fiber delivered from the space between feed roll 11 and feed plate 12 and present it to main cylinder 10. For this Example, the lickerin roll speed was ratioed to the main cylinder, i.e. both used the same mechanical drive. (This is not necessary, as independent speed control of the lickerin has been evaluated across a wide range of 100–950 rpm and found to have little effect on ball formation, or even on their uniformity and/or density). The lickerin clothing was standard 24 ppsi (about 4 pts/sq cm) wire (available from John D. Hollingworth on Wheels, Greenville, S.C.). Lickerin roll 11 rotates in the same direction as feed roll 12, but at a higher surface speed.

(3) A 50 inch (about 1.3 meters) diameter main cylinder 10 clothed with a low point density (132 ppsi, about 20 pts/sq cm), moderately aggressive tooth angle (about 25 degrees positive) clothing (available from John D. Hollingsworth-On-Wheels, Greenville, S.C.). This is a preferred clothing for use with fibers coated with polysiloxane slickeners. This clothing allowed highly slickened fibers to load the main cylinder under the conditions of operation herein in such a fashion as to form an equilibrium 3-dimensional surface topography of fibers embedded in the clothing voids, but still exposed enough of the wiring points to draw fibers away from the lickerin roll and not allow the lickerin to overload. Main cylinder 10 rotates in the opposite direction to lickerin 11 and feed roll 12.

(4) A set of stationary frictional surface elements 14 mounted on the periphery of main cylinder 10. For this Example, almost the entire periphery was covered with ribbed screens (available from Elliott Metal Works, Greenville, S.C.). The first screen 15 (referred to sometimes as the upper back screen) was positioned where a standard backplate would normally be positioned in a carding machine. Screen 15 had a rib spacing of a quarter of an inch (about 6 mm) and contained 34 triangular shaped ribs, the base of the triangle being located closest to, but spaced from, main cylinder 10 and being nominally three eighths of an inch (about 10 mm) in width. The next (top) screen 16 had 11 rectangular-based ribs, with one and a half inches (about 4 cm) rib width and quarter inch (about 6 mm) spacing. Both screens 15 and 16 were standard screens that we used as processing screens, because of the narrow spacing between their ribs. The next (upper front) screen 17 was a doffing screen that was custom made with 23 triangular ribs, of width three eighths inch (about 10 mm), spaced half an inch (about 13 mm) apart. As the screens commercially available were not sufficient to cover the complete periphery of the main cylinder, a conventional smooth plate of 9.5 inch arc length, was used in addition, and located between screens 16 and 17, but is not shown in FIG. 1. The other (bottom front and bottom back) screens 18 and 19 were processing screens, similar to upper back screen 15.

The configuration of these screens on the periphery of the main cylinder was such that staple fibers were forced to unite and begin rolling in the peripheral space around the main cylinder when it reached equilibrium loading (i.e. a steady state condition), which occurred within less than about 10 minutes. Spacing of all screens from the main cylinder was set at 0.080 inch (about 2 mm) for this Example. These spacings are adjustable within limits, and may be varied to control cluster density and size.

As indicated, ribbed screens are not the only stationary elements with frictional surfaces which can be used to achieve a good cluster product. We have successfully used elements with smooth solid surfaces in place of the upper back, top and lower back screens, as shown in FIG. 1. Solid clothed elements can also be used when mounted with the clothing reversed, so that the teeth point in the direction opposite to that used in carding, and with a wide range of point densities; (these are more expensive to make than smooth plates). Although the frictional elements 14 that we have used have been stationary, appropriate to the design of the type of card we have modified, some cards with movable frictional elements may also be modified for use according to out invention, for instance with rollers or belt-driven flat elements.

Control of product removal is accomplished by using one or more ribbed doffing screens (with adequately wide rib-to-rib spacing) according to our invention. These have been located at the upper and lower front screen locations on main cylinder 10, corresponding to where a card is generally doffed. This doffing location is conventional but is not essential, and an advantage may be obtained with other doffing locations, depending on the design and layout of the operation. Wider doffing spacings have been more useful when doffing with a lower screen, such as 18, as centrifugal force is assisted by gravity underneath main cylinder 10. On the upper front (doffing) screen 17, spacings wider than about half an inch (about 13 mm) have resulted in problems in getting the clusters propelled away from the proximity of the main cylinder. We have also noted that free fiber may emerge with the desired clusters if there is a "window" of width as much as three inches (8 cm). This may not be desirable, in general, when the object is to make clusters efficiently. For bonded products however, as indicated by Marcus, it may be desired to provide a mixture of rounded fiberballs and loose binder fiber, in which case free fiber may provide an advantage.

Several variations may prove effective and desirable. For instance, a screen and rib design similar to a venetian blind concept, using adjustable openings, and rib designs providing a Coanda effect may be used to assist centrifugal force in removing the clusters from the main cylinder.

For Example 1, the speed of main cylinder 10 was set and controlled at 250 rpm, and the speed of lickerin 11 was adjusted to provide a normalized fiber feed rate of about 80 90 pph/meter (of the order of 40 Kg/hr/m) card width. The speed of lickerin 11 was ratioed to the main cylinder, and was measured at 180 rpm. Spacing of the peripheral frictional elements 14 from the main cylinder (clothing) was set at 0.080 inch (about 2 mm). Using these settings, satisfactory clusters were produced having free fall bulk densities that were satisfactorily uniform, and measured between 0.55 and 0.70 lbs/cuft (about 9 to about 11 Kg/cu m).

These clusters of our invention (INV) were tested, and compared with refluffable commercial clusters (ART) made from similar fiber using the prior art air-tumbling process described in U.S. Pat. No. 4,618,531, measuring their cohesion (in Newtons) and their bulk (measured as heights, in cm, of the loose clusters, rather than for pillows) under loads of 0.01 psi and of 0.2 psi, (corresponding to about 7 and about 140 Kg/sq m) essentially as described in U.S. Pat. No. 4,618,531. The clusters compared well with such prior clusters in these tests, as can be seen from the results in Table 1.

TABLE 1

| | Cohesion (Newtons) | Heights (cm) at 0.01 psi | Heights (cm) at 0.2 psi |
|---|---|---|---|
| INV | 2.6 | 22.8 | 7.6 |
| ART | 3.3 | 22.3 | 6.2 |

EXAMPLE 2

Four different feed fibers were fed in opened conditioned to the processor as described in Example 1 above, under essentially the same conditions, to demonstrate that ball-like clusters can be made from various types of mechanically-crimped fiber. All four different feed fibers were spun from poly(ethylene terephthalate) polymer supply on a single position of a multi-position commercial spinning machine. Sufficient ends of each type were creeled together to make a suitable crimper denier on a low capacity technical draw machine, were subsequently drawn, mechanically crimped, polysiloxane-slickened (approximately 0.3% Si OWF), relaxed at 175° C. to set the crimp structure and cure the slickener, and then cut to 1.125 inch (about 3 cm) staple having the following properties:

TABLE 2A

| Item | Cross-Section | DPF | Crimps/in | (Crimps/cm) |
|---|---|---|---|---|
| SO | Scalloped oval | 6.7 | 6.7 | (2.6) |
| T | Trilobal (MR about 2.0) | 6.1 | 6.5 | (2.5) |
| RH | Round (one hole) | 6.1 | 5.2 | (2.0) |
| RS | Round (solid) | 6.2 | 5.4 | (2.1) |

As in Example 1, the cohesion and bulk of the clusters were measured and compared with commercial clusters (ART). These measurements (given in Table 2B) indicate that their cohesion and bulk under load varied significantly, depending on the fiber used, and its crimp and configuration, and their cohesion values were not as good as for the spiral crimp fibers of Example 1. Some aspects of the cluster products from these different fibers could possibly be improved by varying the processing conditions.

TABLE 2B

| ITEM | Cohesion (Newtons) | Heights (cm) at 0.01 psi | Heights (cm) at 0.2 psi |
|---|---|---|---|
| SO | 5.8 | 22.2 | 7.0 |
| T | 9.0 | 24.8 | 9.2 |
| RH | 5.1 | 23.7 | 9.0 |
| RS | 4.6 | 23.1 | 7.1 |
| ART | 3.3 | 22.3 | 6.2 |

EXAMPLE 3

The feed fiber for this Example was spun from poly(ethylene terephthalate), of 5.5 dpf (about 6 dtex), mechanically crimped (about 7 cpi, about 3/cm), similarly polysiloxane slickened (about 0.3% Si OWF), 7 hole fiber (total void content about 12%), cut to 1.25 inch (about 3 cm) staple. This fiber was opened on a "Masterclean" opener, as in Examples 1 and 2, prior to feeding to a fiberball making apparatus.

For this Example, the configuration of the frictional surfaces 14 was somewhat different from that used in Example 1 (and as shown in FIG. 1) but the apparatus was otherwise as described hereinbefore. The frictional surfaces 14 were, in order starting from licker-in 11 as follows, with spacings measured from the card clothing on the main cylinder, it being understood that the plates were all smooth or with their card clothing reversed from the normal carding direction, so as not to be opposed to the aggressive clothing on main cylinder 10, and that all lengths are measured along the arcs.

TABLE 3

| No. | Element | Spacing inches | Spacing (mm) |
|---|---|---|---|
| 15 | standard backplate (9.5 inch smooth) | 0.08 | 2 |
| 15A | carding segment (6 inch-72 ppsi reversed) | 0.01 | 0.25 |
| 16A | Cardmaster plate (15 inch-smooth) | 0.08 | 2 |
| 16B | Elliott screen (as top screen in Example 1) | 0.08 | 2 |
| 16C | carding segment (7 inch-378 ppsi reversed) | 0.01 | 0.25 |
| 17 | doffing screen (as in Example 1) | 0.08 | 2 |
| 18 | bottom front screen (as in Example 1) | 0.08 | 2 |
| 19 | bottom back screen (as in Example 1) | 0.08 | 2 |

Main cylinder 10 was driven at 270 rpm, and lickerin 11 at about 195 rpm, with a feed rate of fiber to provide about 80–90 pph of clusters. These clusters were well rounded, were easily transported by air, and remained discrete even after repeatedly being compressed by hand, although they had significantly more free ends than the clusters from Example 1. The product was blown into commercial pillow ticks of regular size, using 22 oz (625 g) filling weights equivalent to commercial pillows (filled with clusters), so that they could be rated visually, both when newly filled and after three standardized stomp and laundry cycles, and were found only slightly less lofty and refluffable than such commercial cluster filling.

EXAMPLE 4

Five lots of feed fiber were processed into clusters according to the invention at a feed rate equivalent to about 54.5 kg/hr. Feed fiber for the first three items was as used for EXAMPLE 1. Feed fiber for items 4 and 5 was as used for EXAMPLE 3.

Apparatus configuration and clearances for the first 3 items were as follows:

TABLE 4A

| NO. | ELEMENT | Spacing inches | Spacing (mm) |
|---|---|---|---|
| 15 | Standard backplate (9.5 inch - smooth) | 0.125 | 3 |
| 15A | Cardmaster plate (15 inch - smooth) | 0.125 | 3 |
| 16A | Cardmaster plate (15 inch - smooth) | 0.125 | 3 |
| 16B | Cardmaster plate (15 inch - smooth) | 0.125 | 3 |
| 16C | Spacer plate (9.5 inch - smooth) | 0.125 | 3 |
| 17 | Doffing Screen (as in EXAMPLE 1) | 0.08 | 2 |
| 18 | Bottom front screen (0.75 inch rib spacing) | 0.08 | 2 |
| 19 | Solid Bottom back screen | 0.08 | 2 |

It will be understood that this item 19, referred to in the carding art as a solid bottom back screen, has no openings, and acts like a smooth standard back plate, but with a lower clearance.

Apparatus for items 4 and 5 was as in TABLE 4A except that all the clearances of 0.125 inches (3 mm) were increased to 0.25 inches (6 mm), while the clearances of 0.08 inches (2 mm) were retained.

The maximum and minimum dimensions of the resulting clusters were measured using a Quantimet 970 Image Analyzer, manufactured by Cambridge Instruments, Ltd. for the numbers of clusters indicated, and the averages are recorded in TABLE 4B, and compared with those for a commercial product (ART) available from Du Pont, and made by the prior art air-tumbling process referred to heretofore. The average volumes were calculated using these maximum and minimum dimensions to calculate an average diameter, and so average volume. Average cluster weights were determined by weighing out 5 samples, each of approximately 2 gms of clusters per sample. Then the numbers of clusters making up the samples were counted, so the density and CV values could then be calculated.

As can be seen from TABLE 4B, the process and apparatus of the invention can be used to make clusters whose shape and density uniformity are at least as good as those of the commercial product (ART) made by the prior art air-tumbling process.

TABLE 4B

| FEED FIBER ITEM | MAIN CYL. (RPM) | SIZE ANALYSIS MAX DIM AVG (MM) | SIZE ANALYSIS MIN DIM AVG (MM) | SIZE ANALYSIS NO. OF CLUSTERS | CALC'D VOL. CC × $10^{-3}$ | WEIGHT ANALYSIS AVG. WT. GM × $10^{-3}$ | WEIGHT ANALYSIS NO OF CLUSTERS | DENSITY (GM/CC) × $10^{-3}$ | DENSITY (% CV) |
|---|---|---|---|---|---|---|---|---|---|
| 4.1 | 250 | 6.58 | 3.30 | 476 | 63.1 | 1.91 | 5257 | 30.2 | 2.48 |
| 4.2 | 350 | 6.39 | 3.12 | 440 | 56.3 | 1.54 | 6502 | 27.4 | 1.20 |
| 4.3 | 180 | 7.63 | 3.87 | 373 | 99.5 | 2.77 | 3626 | 27.8 | 3.85 |
| 4.4 | 250 | 8.63 | 4.40 | 302 | 144.8 | 3.41 | 2954 | 23.5 | 3.20 |
| 4.5 | 350 | 8.05 | 4.05 | 321 | 115.9 | 2.36 | 4254 | 20.4 | 3.48 |
| ART | N/A | 6.96 | 3.42 | 482 | 73.2 | 1.90 | 5362 | 25.9 | 2.31 |

EXAMPLE 5

The feed fiber items for this EXAMPLE were like those for EXAMPLE 3, except of higher dtex (16.7 dtex), and were as follows. Items 1 and 2 were blends containing 15% of binder fibers, whereas Items 3 and 4 contained no binder fiber. The binder fibers were 16.7 dtex sheath-core commercially available binder fibers. The other fibers in these blends had 0.27% Si polysiloxane slickener and 5.2 crimps/inch (cpi). The non-silicone slickener loading on item 3 was a nominal 0.3% and the crimp was 5–5.5 cpi. Item 4 had a loading of silicone slickener of 0.3% Si nominal and a crimp level of 5–5.5 crimps/inch. All items were finished on commercial draw/relax/cut-bale equipment. These items were opened on a "Masterclean" opener, as in EXAMPLES 1 and 2, prior to feeding to the fiberball making apparatus.

TABLE 5A

| ITEM | DESCRIPTION | DTEX | Cut Length (IN.) |
|---|---|---|---|
| 5.1 | Blend with 15% binder fiber | 16.7 | 1.25 |
| 5.2 | Blend with 15% binder fiber | 16.7 | 1.50 |
| 5.3 | Non-Silicone slickener | 16.7 | 1.125 |
| 5.4 | Silicone slickener | 16.7 | 1.50 |

The feed fiber was feed at the same rate as in EXAMPLE 4, with the main cylinder rotating at 250 rpm, except that item 2 was at a rate of 325 rpm. The configuration of the frictional surfaces was as in EXAMPLE 4, except that all the spacings were at 0.125 inches (3 mm).

For this Example, the ratio of maximum dimension (Max. Dim.) to minimum dimension (Min. Dim.) and circularity (which is the ratio of the area of a circle, calculated using the Max. Dim. as the diameter, to the actual area computed for the shape) were computed using Bausch and Lomb Omnicon 5000 image analyzer and standard pre-programmed functions for these two parameters, and the characteristics are recorded in TABLE 5B.

TABLE 5B

| Item | Max. Dim. / Min. Dim. | Circularity | Avg. Wt. (gm) × $10^{-3}$ | Density (gm/cc) × $10^{-3}$ |
|---|---|---|---|---|
| 5.1 | 1.70 | 2.02 | 4.07 | 84.7 |
| 5.2 | 1.58 | 1.86 | 3.26 | 82.5 |
| 5.3 | 1.61 | 1.86 | 3.40 | 51.4 |
| 5.4 | 1.51 | 1.78 | 3.27 | 75.3 |

EXAMPLE 6

This Example shows processing of fiber other than polyester into clusters. The feed fiber was blends of 1.5 dpf, 0.75" cut length, "Kevlar" aramid fiber, and 6 dpf, 38 mm cut length, silicone-slickened, hollow, curvilinear crimp polyester.

For this Example, the configuration of the frictional surfaces 14 was as in EXAMPLES 4 and 5, but the spacings were all increased to 0.25 inches (6 mm). the main cylinder speed was set at 300 rpm, and the feed rate was controlled at about the same rate as in EXAMPLES 4 and 5.

TABLE 6

| Item | "Kevlar Blend Level, Wt. % | Cohesion (newtons) | Height (cm.) @ 5N load | Height (cm.) @ 87N load |
|---|---|---|---|---|
| 6.1 | 10 | 3.2 | 22.6 | 10.2 |
| 6.2 | 20 | 3.2 | 23.5 | 9.8 |
| 6.3 | 30 | 3.1 | 23.5 | 9.8 |

Although much emphasis has been given to the desirability of making round ball-like fiber clusters, such as have proved very desirable for filling purposes, our process and machine may be operated to make rounded clusters or other shapes, e.g. ellipsoids, if this is desired, by using a higher point density for the card clothing, and adjusting the clearances. Also hard, more compact fiber clusters may be produced by our process and machine if such are desired, as our invention provides for flexibility of operation.

We claim:

1. A process for preparing rounded clusters of fibers, comprising feeding a uniform layer of staple fiber onto a peripheral surface of a rotating main cylinder covered with card clothing, advancing the fiber around the peripheral surface and bringing the fiber into contact with a plurality of frictional surfaces, that are spaced radially at least about 2 mm from said clothing, rolling the fiber into rounded clusters by contact with said frictional surfaces, and doffing the rounded clusters from the peripheral surface through at least one arcuate doffing screen that is radially spaced from said clothing and that has openings of sufficient size for the clusters to pass therethrough.

2. A process according to claim 1, comprising doffing said rounded clusters through said doffing screen comprising transverse ribs with bases that are spaced radially at least about 2 mm from said clothing, and that said openings are transverse spaced between said ribs.

3. A process for preparing rounded clusters of fibers, comprising feeding a uniform layer of staple fiber onto a peripheral surface of a rotating main cylinder covered with card clothing and provided with a plurality of essentially arcuate frictional surfaces that are spaced radially from said clothing, to provide a peripheral space therebetween of at least about 2 mm, controlling the rate of feed of said staple fiber so that said clothing becomes loaded with a compressible layer of fibers, rolling the fiber into lofty rounded clusters in the peripheral space between said clothing and said frictional surfaces, and doffing said clusters.

4. A process according to claim 3, comprising doffing said rounded clusters through a doffing screen having openings of sufficient size for the clusters to pass therethrough.

5. A process according to claim 4, comprising doffing said rounded clusters through said doffing screen comprising transverse ribs with bases that are spaced radially at least about 2 mm from said clothing, and that said openings are transverse spaced between said ribs.

6. A process according to claim 2 or 5, comprising doffing said rounded clusters through openings between transverse ribs that are of triangular cross section with bases that are spaced radially at least about 2 mm from said clothing.

7. A process according to any one of claims 1 to 5, comprising advancing the fiber around the peripheral surface through a succession of zones between the cylinder clothing and a plurality of arcuate plates spaced radially at least about 2 mm from the card clothing.

8. A process according to any one of claims 1 to 5, comprising advancing the fiber around the peripheral surface through a succession of zones between the cylinder clothing and a plurality of transversely-ribbed arcuate screens with spaces between the transverse ribs.

9. A process according to any one of claims 1 to 5, comprising bringing the fiber into contact with at least some of said frictional surfaces comprising card clothing whose tooth orientation is not opposed to the direction of rotation of the main cylinder.

10. A process according to any one of claims 1 to 5, comprising assisting doffing and transportation of the emerging clusters by suction and/or blowing.

11. A process according to claim 10, comprising blowing the rounded clusters into tickings for pillows or other filled articles.

12. A process according to any one of claims 1 to 5, comprising feeding the staple fiber to the main cylinder in the form of a cross-lapped batt.

13. A process according to any one of claims 1 to 5, comprising opening staple fiber that has previously been baled, and feeding such opened fiber to the main cylinder.

14. A process according to any one of claims 1 to 5, comprising mechanically crimping the staple fiber before feeding it to the main cylinder.

15. A process according to any one of claims 1 to 5, comprising feeding to the main cylinder staple fiber that is of hollow cross section.

16. A process according to any one of claims 1 to 5, comprising feeding to the main cylinder staple fiber that has been slickened.

17. A process according to any one of claims 1 to 5, comprising feeding to the main cylinder staple fiber that is a blend of polyester fiberfill or other high melting staple fiber blended with lower melting binder staple fiber.

* * * * *